US006674987B2

(12) United States Patent
Nishimura et al.

(10) Patent No.: US 6,674,987 B2
(45) Date of Patent: Jan. 6, 2004

(54) IMAGE FORMING APPARATUS HAVING INTERMEDIATE TRANSFER BODIES, BRUSH ROLLER DEVICES AND TRANSFER ROLL DEVICE HAVING DEFINED AXIAL LENGTHS

(75) Inventors: Shigeki Nishimura, Iwatsuki (JP); Yasuyuki Tsutsumi, Iwatsuki (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/163,348

(22) Filed: Jun. 7, 2002

(65) Prior Publication Data

US 2002/0186989 A1 Dec. 12, 2002

(30) Foreign Application Priority Data

Jun. 12, 2001 (JP) ..... 2001-177606

(51) Int. Cl.[7] ..... G03G 15/00
(52) U.S. Cl. ..... 399/297; 399/302; 399/308
(58) Field of Search ..... 399/297

(56) References Cited

U.S. PATENT DOCUMENTS 5,678,151 A * 10/1997 Miyashiro et al. ..... 399/303
5,999,784 A * 12/1999 Tsukida et al. ..... 399/297

FOREIGN PATENT DOCUMENTS

JP 5-173414 * 7/1993
JP A 2001-7544 1/2001

* cited by examiner

*Primary Examiner*—Quana M. Grainger
(74) *Attorney, Agent, or Firm*—Oliff & Berridge, PLC

(57) ABSTRACT

An image forming apparatus includes an intermediate transfer member to which a toner image is transferred, a transfer roll for transferring the toner image from the intermediate transfer member onto a recording sheet, a brush roll for removing the residual toner from the intermediate transfer member, and a toner collecting device for collecting the toner attached to the surface of the transfer roll. In the apparatus, an axial length of the intermediate transfer member is longer than that of the brush roll, and the axial length of each of the transfer roll and the toner collecting device is longer than that of the intermediate transfer member.

12 Claims, 3 Drawing Sheets

IMAGE FORMING APPARATUS HAVING INTERMEDIATE TRANSFER BODIES, BRUSH ROLLER DEVICES AND TRANSFER ROLL DEVICE HAVING DEFINED AXIAL LENGTHS

BACKGROUND OF THE INVENTION

1. Field of the Invention

The present invention relates to an image forming apparatus, such as an electrophotographic copying machine, and a laser beam printer. More particularly, the invention relates to the improvement of an image forming apparatus constructed such that a toner image formed on an image bearing body, e.g., a photo-receptor drum, is temporarily transferred onto an intermediate transfer body, and then the toner image is transferred from the intermediate transfer body to a recording sheet.

2. Description of the Related Art

Generally, in the image forming apparatus, such as the electrophotographic copying machine or the laser beam printer, a toner image is formed on the surface of a photo-receptor drum in accordance with image data, the toner image is transferred onto a recording sheet, and the toner image transferred is fused and fixed on the recording sheet. Recently, some type of the full-color copying machine or full-color laser beam printer is known. In this type of the machine, formed on the photo-receptor drum is primarily transferred onto the intermediate transfer body. Those color toner images of four colors, yellow, cyan, magenta and black, are superimposed one upon the other to form a composite color toner image. The composite color toner image thus formed is transferred onto a recording sheet thereby to form a full-color image thereon.

A transfer efficiency of the toner image is affected by surface states of the photo-receptor drum and the intermediate transfer body, and resistance variations of the recording sheet and the intermediate transfer body, which results from the temperature and humidity variations. Accordingly, it is difficult to keep the transfer efficiency at 100%. After the transferring of the toner image, residual toner is present on the surfaces of the photo-receptor drum and the intermediate transfer body as the transfer sources of the toner image. To cope with this, cleaning devices are provided downstream of the toner-image transferred parts of the photo-receptor drum and the intermediate transfer body (referred to as "photo-receptor drum and the like"), and remove the residual toner from the photo-receptor drum and the like before the next toner images are formed.

The cleaning device, known and widely used, is such that an elastic rubber blade is pressed against the surface of each of the photo-receptor drum and the like, and the residual toner is mechanically removed by the blade. The cleaning device of the blade type does not need a drive part. Accordingly, it has advantageous features of simple structure and low cost. During the residual toner removing operation, the blade not only removes the toner particles, but also scrapes off the surfaces of the photo-receptor drum and the like as bodies to be cleaned although its scraping amount is extremely small. Damage of the photosensitive layer and the like of the photo-receptor drum, caused by the scraping operation, is great. As a result, the lifetime of the photo-receptor drum and the like is reduced. In particular, recently, there is a tendency of the apparatus size reduction, and in this circumstance, the diameter reduction of the photo-receptor drum and the like is remarkable. Further, there is a tendency of increasing the number of rotation of the photo-receptor drum and the like for a fixed number of print sheets. Accordingly, where the cleaning device of the blade type is employed, the life of the photo-receptor drum and the like is more and more reduced.

For other cleaning devices than the blade type cleaning device, a called fur brush cleaning device is typically known in which a brush roller having a great number of abrasive brushes planted therein is brought into contact with the photo-receptor drum and the like, and the brush roll is rotated at high speed, whereby the residual toner is mechanically removed. The brush roll is driven to rotate by the motor. An efficiency of capturing the toner particles is improved in a manner that a linear velocity ratio of the brush roll to the photo-receptor drum and the like as bodies to be cleaned is selected to be large. In the fur brush cleaning device, the damage of the photo-receptor drum and the like is less than that in the blade type cleaning device. Accordingly, the life of the photo-receptor drum and the like will be increased correspondingly.

In the fur brush cleaning device, the brush roll is in sliding contact with the surfaces of the photo-receptor drum and the like. Accordingly, a called toner cloud in which toner particles flow in the air is easy to be generated. In particular, much toner cloud is generated at both ends of the brush roll. If no measure is taken for the toner cloud, the toner particles attach to the devices within the image forming apparatus. And, the recording sheet being transported within the image forming apparatus is soiled with the toner particles. The toner cloud is discharged out of the image forming apparatus, and will contaminate the air in the room and adversely affects the human body.

In the conventional cleaning device, the abrasive bristles of the brush roll are struck against the flicker bar to thereby forcibly shake the toner particles from the brush roll, and the toner particles are collected. Therefore, there is less chance that the brush roll continues its rotation while holding much toner particles. Recently, the size reduction of the cleaning device progresses, and there is proposed a cleaning device not provided with a toner collecting mechanism (Japanese patent laid-open No. 2001-07544). In this new cleaning device, the brush roll functions to temporarily hold the residual toner particles during the execution of the image forming job so as not to hinder the formation and transfer of the toner images. During the execution of the image forming job, the toner particles held by the brush roll are discharged, at intervals, to the photo-receptor drum and the like, and transported to the roll located downstream as in the case of transferring the toner image. Finally, the toner particles are collected by the cleaning device provided for the final stage roll. For this reason, the brush roll continues its rotation while holding the residual toner having been removed from the photo-receptor drum and the like. Accordingly, much toner cloud is easy to be generated when the brush roll is brought into sliding contact with the photo-receptor drum and the like, when comparing with the conventional cleaning device.

In a method, frequently used, of preventing the inside of the image forming apparatus from being filled with the toner cloud generated in the cleaning device, the brush roll is surrounded by a casing. A sealing member, which comes in contact with the photo-receptor drum and the like, is provided at the edge of the casing thereby to prohibit the toner cloud generated by the sliding of the brush roll from leaking outside the casing. Another frequently used method is that the air around the cleaning device is sucked by a fan, and toner particles are removed from the sucked air by use of a filter.

In the former method, a gap through which the toner cloud leaks is closed by making the sealing member contact with the photo-receptor drum and the like. Therefore, the wear of the photo-receptor drum and the like is problematic, and deterioration of the sealing member per is also problematic. The latter method needs the fan and suction duct, resulting in increase of manufacturing cost, and hindering of the size reduction of the image forming apparatus.

SUMMARY OF THE INVENTION

Accordingly, an object of the present invention is to provide an image forming apparatus operable such that even when the brush roll brushes a photo-receptor drum and the like to generate a toner cloud, the apparatus is capable of preventing the toner cloud from diffusing into the image forming apparatus, such as a copying machine or a printer, without using a sealing member of the contact type, a fan for absorbing the toner cloud, and the like, whereby the cleaning of the inside of the machine as well as the reduction of the cost to manufacture is realized.

To achieve the above object, there is provided an image forming apparatus having an image bearing body having a photosensitive layer on the surface thereof, a toner image as defined by image information being formed on the photosensitive layer, an intermediate transfer body to which a toner image is transferred from the image bearing body, a transfer roll device for transferring the toner image from the intermediate transfer body onto a recording sheet, a brush roll device for removing the residual toner from the intermediate transfer body, and a toner collecting device for collecting the toner attached to the surface of the transfer roll device, the improvement being characterized in that an axial length of the intermediate transfer body is longer than that of the brush roll device, and the axial length of each of the transfer roll device and the toner collecting device is longer than that of the intermediate transfer body.

The axial length of the intermediate transfer body of which the residual toner is removed by the brush roll member is longer than that of the brush roll device. A toner cloud generated at both ends of the brush roll device when the brush roll device is rotated, attaches to both ends of the intermediate transfer body which are protruded from the brush roll device, thereby minimizing the diffusion of the toner cloud into the inside of the machine. The axial length of the transfer roll device for transferring the toner image from the intermediate transfer body to the recording sheet is longer than that of the intermediate transfer body. Accordingly, the toner attached to both ends of the intermediate transfer body when it is rotated maybe transferred from the intermediate transfer body to the transfer roll device. Finally, the toner collecting device provided on the transfer roll device collects the toner. Accordingly, the diffusion of the toner cloud generated at both ends of the brush roll device into the image forming apparatus is minimized.

The axial length of the brush roll device is not its axial length including the rotary shaft, but is the axial length of a part of the rotary shaft of the brush roll device at which the abrasive bristles are provided. The reason for this is that the part of the brush roll device at which the abrasive bristles are provided functions as the brush roll device.

The intermediate transfer body for transferring the toner between the image bearing body and the recording sheet does not always consist of one stage of intermediate transfer body. The intermediate transfer body may include a primary intermediate transfer member to which a toner image is primarily transferred from the image bearing member, and a secondary intermediate transfer member to which a toner image is secondarily transferred from the primary intermediate transfer member. In this case, the first brush roll for removing the residual toner is provided on the primary intermediate transfer member, and a second brush roll for removing the residual toner is provided on the secondary intermediate transfer member. To minimize the diffusion of the toner clouds generated at both ends of the first and second brush rolls into the inside of the image forming apparatus, the axial length of the primary intermediate transfer member must be longer than that of the first brush roll, and the axial length of the secondary intermediate transfer member must be longer than that of the second brush roll. In order that when the toner attached to both ends of the primary intermediate transfer member is transferred to the secondary intermediate transfer member, the toner is reliably removed from the secondary intermediate transfer member, the axial length of the second brush roll must be longer than that of the primary intermediate transfer member.

In implementation of the invention, the brush roll device (referred to as a refresher brush), like that of the intermediate transfer body, is provided for the image bearing body. The toner attached onto the image bearing body is removed by use of the refresher brush. To suppress the toner cloud generated at both ends of the refresher brush from diffusing into the image forming apparatus, The axial length of a photosensitive layer formed on the surface of the image bearing body is longer than that of the refresher brush, and the axial length of the intermediate transfer body is longer than that of the photosensitive layer. The reason why the axial length of the photosensitive layer is discussed as a great matter in the specification follows. If the photosensitive layer having such a length is used, a potential gradient may be formed between the photosensitive layer and the intermediate transfer body. If so done, the transfer of the toner that is attached, in the form of toner cloud, to both ends of the image bearing body to the intermediate transfer body may be suppressed to some degree.

DETAILED DESCRIPTION OF THE PREFERRED EMBODIMENTS

The preferred embodiments of an image forming apparatus constructed according the present invention will be described in detail with reference to the accompanying drawings.

Figure 1:
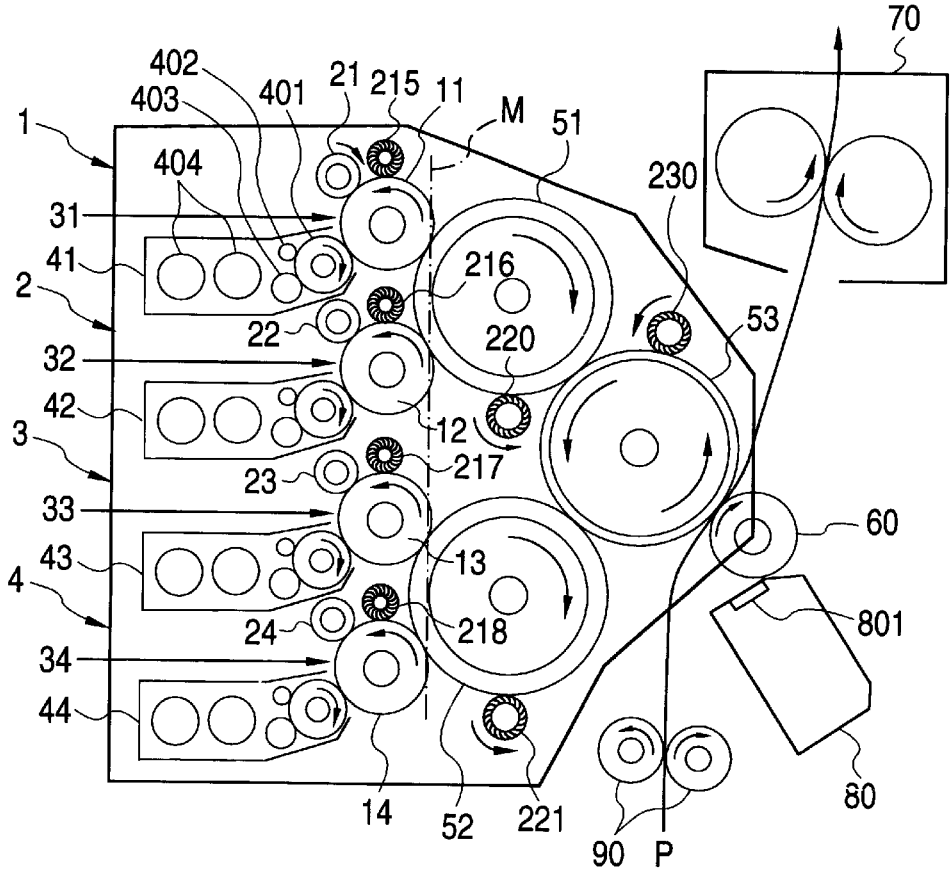
FIG. 1 is a view schematically showing a full-color laser beam printer according to an embodiment of the present invention.

FIG. 1 is a view schematically showing a full-color laser beam printer which is an embodiment of the present invention. In FIG. 1, each of arrows designates a rotational direction of each of rotational members.

A key portion of the full-color printer, as shown in FIG. 1, is made up of photo-receptor drums 11 to 14 of colors of yellow "Y", magenta "M", cyan "C" and black "K", charging rolls 21 to 24 for primary charging which are in contact with the photo-receptor drums 11 to 14, a laser optical unit (not shown) which emits laser lights of yellow "Y", magenta "M", cyan "C" and black "K", developing units 41 to 44, a first primary intermediate transfer drum 51 being in contact with two to-receptor drums 11 and 12 of four photo-receptor drums 11 to 14, a second primary intermediate transfer drum 52 being in contact with other two photo-receptor drums 13 and 14, a secondary intermediate transfer drum 53 being in contact with the first and the second primary intermediate transfer drums 51 and 52, and a final transfer roll 60 being in contact with the secondary intermediate transfer drum 53.

Of those structure, the photo-receptor drums 11 to 14, the charging rolls 21 to 24, the developing units 41 to 44, the first and the second primary intermediate transfer drum 51 and 52, and the secondary intermediate transfer drum 53 are assembled into a single image forming unit 1. In a case, for example, where a deterioration of the photo-receptor drum impairs image quality, the whole of image forming unit 1 is replaced.

The photo-receptor drums 11 to 14 are disposed at fixed spatial intervals to be aligned with one another in a common tangent plane M. The first and the second primary intermediate transfer drums 51 and 52 are disposed so that their rotational shafts are in parallel with the shafts of the photo-receptor drums 11 to 14, and those transfer drums are arranged to be plane symmetric with each other with respect to a predetermined plane of symmetry. The secondary intermediate transfer drum 53 is disposed such that its rotational shaft is in parallel with the shafts of the photo-receptor drums 11 to 14.

To form a full-color image, signals representative of image data of different colors are rasterized by an image processing unit (not shown), and is input to the laser optical unit. In the laser optical unit, the laser lights 31 to 34 of yellow (Y), magenta (M), cyan (C) and black (K) are modulated and irradiated onto the corresponding photo-receptor drums 11 to 14.

Known electrostatographic image forming processes for the colors are carried out around the photo-receptor drums 11 to 14. A photo-receptor drum using an OPC material is used for each of the photo-receptor drums 11 to 14. The surfaces of the photo-receptor drums 11 to 14 are uniformly charged to about −300V, for example, by applying a DC voltage of about −800V to the charging rolls 12, 22, 32, 42. In the embodiment, only a voltage containing a DC component is applied to the charging rolls, but it may be replaced with a voltage formed by superimposing an AC component to a DC component.

The laser optical unit emits laser lights 31 to 34 modulated in accordance with input image information of the respective colors and irradiates the surfaces of the photo-receptor drums 11 to 14 having uniform surface potentials thus formed, so that electrostatic latent images defined by the image information of those colors are formed at predetermined timings on the surfaces of the photo-receptor drums. Thus, the electrostatic images are written by the laser optical unit, so that the surface potentials at exposed parts on the photo-receptor drums 11 to 14 are discharged to have a potential of −60V or lower.

The electrostatic latent images of the respective colors of yellow (Y), magenta (M), cyan (C) and black (K), which are formed on the surfaces of the photo-receptor drums 11 to 14 are developed, by the developing units 41 to 44 of the corresponding colors, into toner images of the respective colors of yellow (Y), magenta (M), cyan (C) and black (K) on the photo-receptor drums 11 to 14. The developing units 41 to 44 are respectively filled with developers containing carriers and different color toners of yellow (Y), magenta (M), cyan (C) and black (K). When the developing units 41 to 44 are supplied with toners from toner supplying devices (not shown), the supplied toners and the carriers are sufficiently agitated by an auger 404, whereby the toners are friction-charged. A magnet roll (not shown) is fixedly disposed within each developing roll 401. In the magnet roll, a plurality of magnetic poles are disposed while angularly being arranged at predetermined angles. The developer is transported to a position near the surface of each developing roll 401 by a paddle 403 for transporting the developer to the developing roll 401, and a quantity of the developer to be transported to the developing part is regulated by a developer-amount regulating member 402.

The toner having been supplied onto the developing roll 401 takes the form of a magnetic brush consisting of the carriers and the toner, by a magnetic force of the magnet roll. The magnetic brush is in contact with the photo-receptor drums 11 to 14. A developing bias voltage of AC+DC components is applied to the developing roll 401, so that the toners on the developing rolls 401 are applied to the electrostatic latent images formed on the photo-receptor drums 11 to 14, thereby forming toner images. In the instant embodiment, the AC bias voltage is 4 kHz in frequency and 1.5 kVpp in voltage, and the DC bias voltage is about −230V.

The color toner images of yellow (Y), magenta (M), cyan (C) and black (K), which are formed on the photo-receptor drums 11 to 14, are electrostatically and primarily transferred onto the first primary intermediate transfer drum 51 and the second primary intermediate transfer drum 52. The toner images of yellow (Y) and magenta (M), which are formed on the photo-receptor drums 11 and 12, are transferred onto the first primary intermediate transfer drum 51. The toner images of cyan (C) and black (K) formed on the photo-receptor drums 13 and 14 are transferred onto the second primary intermediate transfer drum 52. By shifting writing start timings of writing electrostatic latent images onto the photo-receptor drums 11 to 14 for those colors, a duplex color image formed by appropriately superimposing the primarily transferred toner images of yellow (Y) and magenta (M), is formed on the first primary intermediate transfer drum 51. Another duplex color image formed by appropriately superimposing the toner images of cyan (C) and black (K) is formed also on the second primary intermediate transfer drum 52.

The surface potential necessary for electrostatically transferring the toner images from the photo-receptor drums 11 to 14 to the first and second primary intermediate transfer drums 51 and 52, is within +250 to 500V. The optimum surface potential varies depending on a charging state of toner, and atmospheric temperature and humidity. When the charge quantity of the toner is within the range of −20 to 35 $\mu$C/g and the apparatus is placed in ambient conditions of normal temperature and humidity, it is preferable that the surface potentials on the first and second primary intermediate transfer drums 51 and 52 are at about +380V. The first and second primary intermediate transfer drums 51 and 52 are each designed such that the resistance value is about $10^3$ Ω, and a metal pipe made of Fe or Al is covered with a low-resistance elastic rubber layer ($R=10^2$ to $10^3$ Ω), which is made of conductive silicon rubber or the like. Further, a fluorine rubber layer having a thickness of 3 to 100 $\mu$m as a high release layer is formed on the surface of the low-resistance elastic rubber layer, and those are bonded together by an adhesive (primer) of silane coupling agent. The release layer is about $10^5$ to $10^9$ Ω($R\approx10^5$ to $10^9$ Ω) in resistance.

Thereafter, the toner images of duplex color formed on the first and second primary intermediate transfer drums 51 and 52 are electrostatically and secondarily transferred onto the secondary intermediate transfer drum 53. Consequently, a final toner image of four colors, yellow (Y), magenta (M), cyan (C) and black (K), which are superimposed, is formed on the secondary intermediate transfer drum 53.

A surface potential necessary for electrostatically transferring the toner images from the first and second primary intermediate transfer drums 51 and 52 onto the secondary intermediate transfer drum 53 is within a range of about 600 to 1200V. An optimum surface potential varies depending on a charging state of toner, and atmospheric temperature and humidity, as well as the case of primary transferring. What is necessary for the toner image transfer is the potential difference between the first and second primary intermediate transfer drums 51 and 52 and the secondary intermediate transfer drum 53. Therefore, the surface potential of the secondary intermediate transfer drum 53 must be selected in connection with the surface potentials of the first and second primary intermediate transfer drums 51 and 52. When as described above, the charge quantity of the toner is within −20 to −35 $\mu$C/g, the apparatus is placed in ambient conditions of normal temperature and normal humidity, and the surface potential of the first and second primary intermediate transfer drums 51 and 52 is about +380V, the surface potential of the secondary intermediate transfer drum 53 is preferably selected to be about +880V, viz., the potential difference between the secondary intermediate transfer drum 53 and the first and second primary intermediate transfer drums 51 and 52 are preferably selected to be at about +500V.

The secondary intermediate transfer drum 53 used in this embodiment, is designed to have an outside diameter equal to that of each of the first and second primary intermediate transfer drums 51 and 52, and to have a resistance value of about $10^{22}$ Ω. The secondary intermediate transfer drum 53 as well as the primary intermediate transfer drums is designed such that a metal pipe made of Fe or Al is covered with a low-resistance elastic rubber layer ($R=10^2$ to $10^3$ Ω) of 0.1 to 10 mm thick, which is made of conductive silicon rubber or the like. The surface of the low-resistance elastic rubber layer is covered with a release layer made of fluorine rubber of 3 to 100 $\mu$m thick. Here, the resistance value of the secondary intermediate transfer drum 53 must be selected to be higher than that of each of the first and second primary intermediate transfer drums 51 and 52. Otherwise, the secondary intermediate transfer drum 53 charges the first and second primary intermediate transfer drums 51 and 52. And it is difficult to control the surface potential of the first and second primary intermediate transfer drums 51 and 52.

Finally, the quadruplex color toner image formed on the secondary intermediate transfer drum 53 is tertially transferred onto the recording sheet, which travels along a sheet transporting path P, by the final transfer roll 60. Following the sheet feeding process (not shown), the recording sheet passes a sheet transport roll 90, and is fed to a nip area between the secondary intermediate transfer drum 53 and the final transfer roll 60. After the final transferring process, the final toner image formed on the recording sheet is fused and fixed by a fixing unit 70. Here, a sequence of the image forming process steps end.

In the laser beam printer of the embodiment thus constructed, cleaning devices are provided for the photo-receptor drums 11 to 14, and for the first and second primary intermediate transfer drums 51 and 52.

The cleaning device provided for the photo-receptor drum 11 includes a refresher brush 215 having electrostatic abrasive bristles erecting on the metal rotary shaft. The cleaning device is disposed upstream of the charging roll 21 as viewed in the rotational direction of the photo-receptor drum 11 in order to prevent toner particles from attaching to the charging roll 21. The refresher brush 215 is applied with a cleaning bias voltage, and temporarily collects toner particles having reversed polarity from the surface of the photo-receptor drum 11 at each transfer part thereon, and holds the collected toner particles till a cleaning mode operation to be described later starts. Specifically, the toner is negatively charged in the developing unit 41. Accordingly, in the respective transferring process steps, the toner image is transferred to a position having a higher potential. When the toner image repeatedly passes through a transfer part in the transferring process steps, a part of the negatively charged toner is sometimes charged to have a reverse polarity, e.g., positive polarity, by Paschen discharge or charge injection. The polarity reversed toner particles are not transferred to the nest process step, but it reversely flows to the upstream side, and finally, the toner particles are transferred to the photo-receptor drum 11 and further attach to the charging roll 21. The refresher brush 215 is provided for catching the polarity reversed toner particles before those reach the charging roll 21, thereby preventing the toner particles from attaching to the charging roll 21. To this end, at the time of forming the toner image, the refresher brush 215 is applied with a potential of −400V lower than the surface potential of −300V on the photo-receptor drum 11. No driving device is provided for the refresher brush 215. The refresher brush 215 rotates following the rotating photo-receptor drum 11, by a friction force acting between the abrasive bristles thereof and the photo-receptor drum 11.

While the refresher brush 215 provided for the photo-receptor drum 11 has been described, refresher brushes 216 to 218 each having the same structure as of the refresher brush 215 are provided for the other photo-receptor drums 12 to 14, respectively.

First brush rolls 220 and 221 having electrostatic abrasive bristles erecting on the metal rotary shafts, are provided for the primary intermediate transfer drums 51 and 52, respectively. The first brush roll 220 is disposed at a position at which it blocks the toner particles left on the primary intermediate transfer drum 51 after the secondary transfer process, before the photo-receptor drum 12. The first brush roll 221 is disposed at a position at which it blocks toner particles left on the primary intermediate transfer drum 52 after the secondary transfer process, before the photo-receptor drum 14.

The first brush rolls 220 and 221 are applied with a cleaning bias voltage whose polarity is reverse to that of the bias voltage applied to the refresher brush 215. In the primary transfer process, each of the photo-receptor drums transfers a toner image of one color to the primary intermediate transfer drum 51 (52). With this feature, a transfer efficiency may be set at a high level. For this reason, even if the cleaning devices for collecting residual toner are not used, great problem is not presented to the image formation process. No color mixing occurs in the developing units 41 to 44. In the secondary transfer process, the toner images of two colors, which are superimposed one upon the other, are transferred to the secondary intermediate transfer drum 53. A large amount of toner is left on the primary intermediate transfer drums 51 and 52, while not transferred. If such residual toner is not collected by the cleaning devices, ghosts appear in the toner image to next be transferred to the primary intermediate transfer drums. To avoid this, the first brush rolls 220 and 221 are each applied with a cleaning bias voltage (e.g., +800V) higher than that of the surface potentials of the first primary intermediate transfer drums 51 and 52 so that the negatively charged residual toner electrostatically transfers from the primary intermediate transfer drums 51 and 52 to the first brush rolls 220 and 221. When the surface potentials of the primary intermediate transfer drums 51 and 52 vary due to the variation of atmospheric environmental conditions, such as temperature and humidity, it is necessary to vary the cleaning bias voltage to secure the potential difference between the first brush rolls 220 and 221 and the primary intermediate transfer drums 51 and 52. Each of those brush rolls rotates following the rotating primary intermediate transfer drums 51 and 52, by a friction force acting between the abrasive bristles and the primary intermediate transfer drums 51 and 52, in the same way as of the refresher brush 215.

A second brush roll 230 for removing the residual toner which are left after a tertiary transfer process ends is provided for the secondary intermediate transfer drum 53. Unlike the first brush rolls 220 and 221, and the refresher brushes 215 to 218, the second brush roll 230 is driven to rotate by a motor (not shown), in a direction opposite to the rotational direction of the secondary intermediate transfer drum 53. The reason for this is that in the tertiary transfer process which simultaneously transfers the toner images of the four colors to a recording sheet P, much residual toner is present on the secondary intermediate transfer drum 53, and even if a cleaning bias voltage is applied to the brush roll, it is impossible to completely catch the residual toner by merely rotating the second brush roll 230 in a follower manner. In particular, in a case where a toner image is tertially transferred to a recording sheet having high resistance, such as an OHP sheet, it is necessary to apply a larger transfer bias voltage to the transfer roll 60 in order to secure the flow of a transfer current having a predetermined amplitude between the secondary intermediate transfer drum 53 and the transfer roll 60. If so done, a polarity of the toner is not reversed, but the charge amount of the toner is reduced. Accordingly, an amount of toner which is not transferred to the recording sheet but left as a residual toner on the secondary intermediate transfer drum 53, is large.

The second brush roll 230 is also applied with a cleaning bias voltage. For the purpose of removing the residual toner produced by the tertiary transfer process, from the surface of the secondary intermediate transfer drum 53, a polarity of the cleaning bias voltage is the same as of the bias voltage applied to the first brush rolls 220 and 221. Specifically, the second brush roll 230 is applied with a cleaning bias voltage (e.g., +1080V) higher than that of the surface potential of the secondary intermediate transfer drum 53 so that the (−) charged residual toner electrostatically transfers from the secondary intermediate transfer drum 53 to the second brush roll 230.

The refresher brushes 215 to 218, the first brush rolls 220 and 221, and the second brush roll 230 respectively catch toner particles from the photo-receptor drums 11 to 14, the primary intermediate transfer drums 51 and 52, and the secondary intermediate transfer drum 53, those drums facing to the former brushes and rolls. However, those brushes and rolls have no mechanisms to discharge the toner particles as caught. Accordingly, when the toner image is repeatedly formed, the captured toner particles flow out through the abrasive bristles of the brush roll. To cope with this, the printer of the embodiment performs the following cleaning operations to collect the captured toner at predetermined timings, e.g., before printing operation, after printing operation, every predetermined number of print sheet at the time of continuous printing. And the toner temporarily held by the brush rolls is collected by a final collection device 80 provided for the transfer roll 60

In the cleaning operation, voltages having successive potential gradients so that the negative potential of the transfer roll 60 is highest, are applied to the charging rolls 21 to 24, the refresher brushes 215 to 218, the photo-receptor drums 11 to 14, the primary intermediate transfer drums 51 and 52, the secondary intermediate transfer drum 53 and the transfer roll 60. With such voltage application, the positively charged toner particles of the having reverse polarity which are held by the refresher brushes 215 to 218 during the printing operation, are successively transferred to the transfer roll 60. Then, the toner thus transferred is collected by the final collection device 80 disposed while being in contact with the transfer roll 60. In the final collection device 80, a cleaning blade 801 made of elastic material, such as silicon rubber, is in contact with the peripheral surface of the transfer roll 60. The toner particles transferred to the transfer roll 60 are scraped off by the cleaning blade 801 and are collected into the collection device. Accordingly, when the cleaning operation starts, the positively charged toner particles temporarily caught by the refresher brushes 215 to 218, are discharged onto the photo-receptor drums 11 to 14, and then, the refresher brushes 215 to 218 resume their clean state.

When the cleaning operation of positively charged toner particles ends, the potentials equal to those at the time of forming the toner images are applied to the charging rolls 21 to 24, the primary intermediate transfer drums 51 and 52, the secondary intermediate transfer drum 53 and the transfer roll 60. On the other hand, potentials whose polarity is reverse to that the time of forming the images, are applied to the first and second brush rolls, whereby the negatively charged toner particles attaching to first brush rolls 220 and 221, and a second brush roll 230 are removed for cleaning. Thus, by applying potentials whose polarity is reverse to that in the image formation to the first brush rolls 220 and the second brush roll 230, the negatively charged toner particles caught by those brushes are discharged onto the primary intermediate transfer drums 51 and 52, and the secondary intermediate transfer drum 53. Then, those toner particles are transferred by way of the secondary intermediate transfer drum 53, and reach the finally transfer roll 60, as in the usual toner image transfer, and the toner particles are collected by the final collection device 80.

By performing such the cleaning operation periodically, the toner particles of either polarity are collected by the final collection device 80, whereby the brush roll is put in a clean state.

As seen from foregoing description, in the laser beam printer of the embodiment, during the formation of the toner images, the refresher rolls 215 to 218, and the first and second brush rolls 220, 221 and 230 rotate, while holding the toner particles removed from the photo-receptor drums 11 to 14 and the intermediate transfer members 51 to 53. In the other cleaning mode mentioned above, those brush rolls continue their ration, while discharging the captured toner particles onto the photo-receptor drums 11 to 14 and the intermediate transfer members 51 to 58. Therefore, toner cloud is easy to be generated around those brush rolls. Much toner cloud is generated in particular at both ends of the brush rolls in the axial direction, i.e., regions just outside the area of the bristles provided therein, when comparing with a central part of each brush roll in the axial direction. For this reason, to prevent the inside of the image forming apparatus from being soiled, it is important how to prohibit the toner cloud generated by the rotation of each brush roll, particularly the toner cloud at both ends of the brush roll as viewed in the axial direction, from diffusing.

Figure 2:
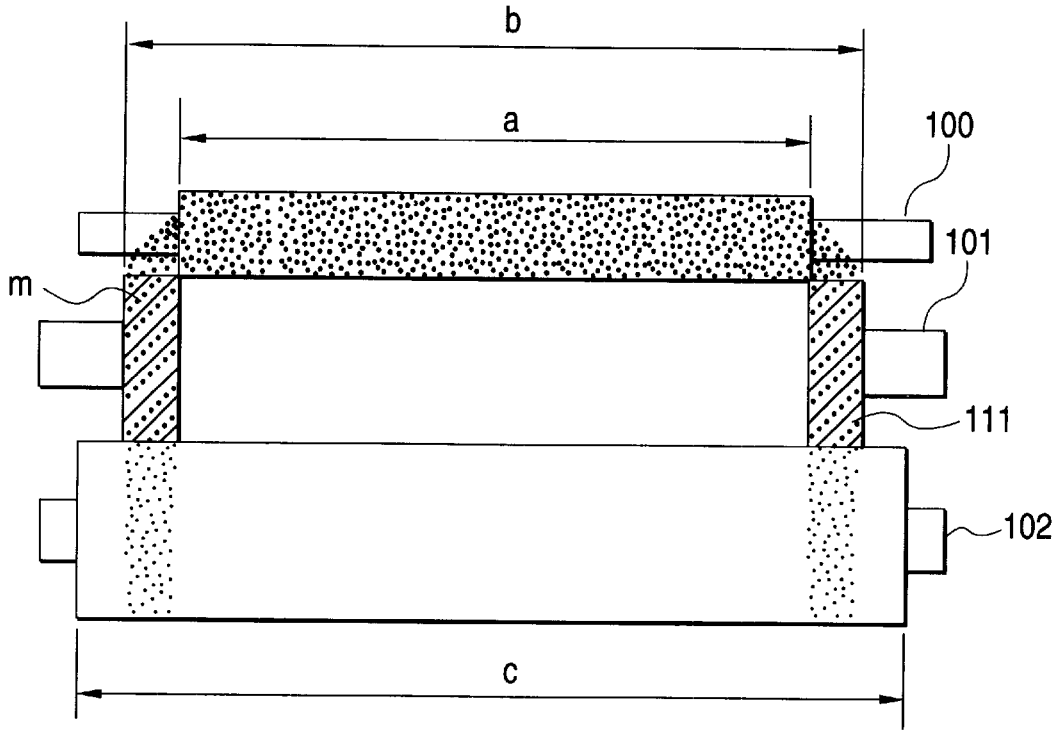
FIG. 2 is a diagram schematically showing the concept of the present invention.

To cope with this, in the printer of the embodiment, as shown in FIG. 2, an axial length "b" of a body to be cleaned 101, which is cleaned by a brush roll 100, is selected to be longer than an axial length "a" of the brush roll 100. By so selecting the sizes of those members, non-cleaning areas "m", which are not cleaned by the brush roll 100, are provided at both ends of the shaft of the body to be cleaned 101. Most of toner cloud, which is generated by the rotation of the brush roll 100, is generated when the abrasive bristles are brought into contact with the body to be cleaned 101 and it repels the toner particles. An amount of toner cloud is negligible in the cleaning area where the bristles are continuously present, but much toner cloud is generated at both ends of the cleaning area. Therefore, if the non-cleaning areas "m" not abraded with the brush roll 100 are provided on both ends of the shaft of the body to be cleaned 101, floating toner particles generated outside the abrasive bristles of the brush roll 100 attach to the non-cleaning area "m", thereby suppressing the generation of the toner cloud.

In order that the toner particles stuck to both ends of the shaft of the body to be cleaned 101 are finally collected in the lump by the final collection device 80 provided for the transfer roll 60. an axial length "c" of a downstream roll 102 onto which a toner image is transferred from the body to be cleaned 101 is selected to be longer than the axial length "b" of the body to be cleaned 101. In this case, if the axial length "c" of the downstream roll 102 is equal to the axial length of the body to be cleaned 101, no problem arises. To smoothly guide the toner particles stuck to the non-cleaning areas "m" of the body to be cleaned 101, it is preferable that the axial length of the roll is longer than the axial length "b" of the body to be cleaned 101.

Figure 3:
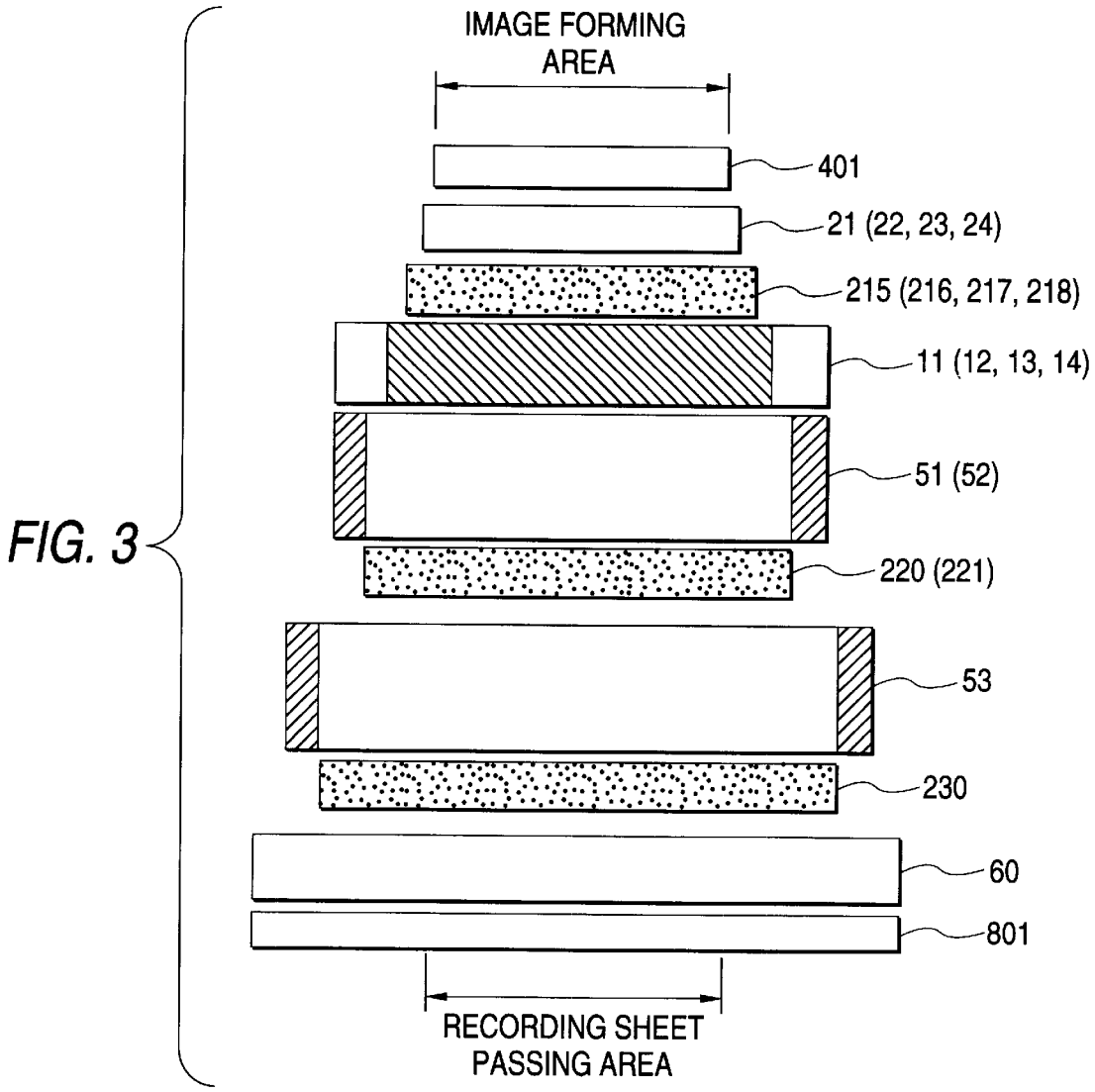
FIG. 3 is a diagram comparatively showing the axial lengths of the rolls, which are used in a printer of the embodiment.

FIG. 3 is a diagram comparatively showing the axial lengths of the rolls, which are used in the laser beam printer of the embodiment. As generally described using FIG. 2, in the laser beam printer, the axial length of the second brush roll 230 is shorter than that of the secondary intermediate transfer drum 53. Non-cleaning areas (hatched in the figure), which are not brushed with the second brush roll 230, are formed on both ends of the secondary intermediate transfer drum 53 as viewed in the axial direction. The transfer roll 60 for tertially transferring the toner image onto the secondary intermediate transfer drum 53 is selected to be longer than the axial length of the secondary intermediate transfer drum 53. Accordingly, the floating toner particles generated near both ends of the shaft of the second brush roll 230 attach to the non-cleaning areas of both ends of the rotary shaft of the secondary intermediate transfer drum 53. And the toner particles move to the reverse side of the transfer roll 60 simultaneously with the tertially transferring of the toner image onto the recording sheet. Finally, the toner particles are scraped off the surface of the transfer roll 60 by the cleaning blade 801, which is in contact with the surface of the transfer roll 60, and are collected by the final collection device 80.

The axial length of the first brush roll 220 is also selected to be shorter than the axial length of the primary intermediate transfer drum 51. Non-cleaning areas "m" (hatched in the figure), which is not brushed with the first brush roll 220, are formed on both ends of the primary intermediate transfer drum 51 as viewed in the axial direction. The axial length of the secondary intermediate transfer drum 53 onto which the toner image is secondarily transferred from the primary intermediate transfer drum 51 is selected to be longer than that of the primary intermediate transfer drum 51. Accordingly, the floating toner particles (toner cloud) generated near both ends of the shaft of the first brush roll 220 attach to the non-cleaning areas provided on both ends of the shaft of the primary intermediate transfer drum 51. And the toner particles move to the surface of the secondary intermediate transfer drum 53 with the secondarily transferring of the toner image. Additionally, the axial length of the second brush roll 230 is selected to be longer than that of the primary intermediate transfer drum 51. The toner having been transferred from the non-cleaning areas of the primary intermediate transfer drum 51 to the secondary intermediate transfer drum 53 is necessarily removed from the surface of the secondary intermediate transfer drum 53 by means of the second brush roll 230.

Further, the axial length of the refresher brush 215 is selected to be shorter than that of a photosensitive layer "p" formed on the surface of the photo-receptor drum 11. Non-cleaning areas, which are not brushed with the refresher brush 215, are formed on both ends of the photosensitive layer "p" (hatched areas) of the photo-receptor drum 11 as viewed in the axial direction. The axial length of the primary intermediate transfer drum 51 onto which the toner image is primarily transferred from the photo-receptor drum 11 is selected to be longer than that of the photosensitive layer "p" on the photo-receptor drum 11. Floating toner particles (toner cloud) generated near both ends of the shaft of the refresher brush 215 attach to the non-cleaning areas on both ends of the photosensitive layer "p". The refresher brush 215 temporarily holds the polarity reversed toner particles, i.e., toner particles positively charged. Accordingly, the toner particles attaching to the non-cleaning areas of the photosensitive layer "p" have a positive polarity. Accordingly, those attaching toner particles remain attaching to the photo-receptor drum during the image forming process. When the cleaning mode is executed, at the timing that the refresher brush 215 discharges the positively charged toner particles onto the photo-receptor drum 11, the attaching toner particles move to the surface of the primary intermediate transfer drum 51, together with the positively charged toner particles discharged. By executing the cleaning mode, the toner particles move to the surface of the secondary intermediate transfer drum 53, from the surface of the primary intermediate transfer drum 51. Finally, the toner particles attach to the transfer roll 60, and are scraped off the transfer roll 60 by the cleaning blade 801, and collected into the final collection device 80.

The refresher brush 215 prevents the polarity reversed toner particles from attaching to the charging roll 21. Accordingly, the axial length of the charging roll 21 is selected to be shorter than that of the refresher brush 215. The charging roll 21 charges the photosensitive layer "p" of the photo-receptor drum 11 to a predetermined background potential. No toner particles attach to at least the area charged at the background potential in connection with the developing bias voltage applied to the developing unit 41. Accordingly, to prevent the toner from soiling unnecessary parts, the axial length of the developing roll 401 of the developing unit 41 is selected to be shorter than that of the charging roll 21.

Therefore, in the laser beam printer in the instant embodiment, the axial length of the developing roll 401 is shortest, and the axial lengths of the photo-receptor drum 11, primary intermediate transfer drum 51, secondary intermediate transfer drum 53 and the transfer roll 60 increase in this order. The width of the maximum toner image forming area should be shorter than that of the developing roll 401.

Therefore, design may be made such that the axial lengths of the primary intermediate transfer drum 51, secondary intermediate transfer drum 53 and the transfer roll 60 are determined as mentioned above, and the floating toner particles generated at the first brush roll 220 and the second brush roll 230 are captured at both ends of the shafts of the primary intermediate transfer drum 51 or secondary intermediate transfer drum 53. If so designed, the floating toner particles attaching to the primary intermediate transfer drum 51 or the secondary intermediate transfer drum 53 do not adversely affect the image quality of the toner image.

An area on the transfer roll which receives the floating toner particles from the secondary intermediate transfer drum is spaced apart from an area on the same which the recording sheet passes. Accordingly, it is prevented that the toner particles attaching to the transfer roll soils the reverse side of the recording sheet.

As seen from the foregoing description, in the image forming apparatus of the invention, the axial length of the intermediate transfer body from which the residual toner is removed with the brush roll device is selected to be longer than that of the brush roll device. Further, the axial length of the transfer roll device for transferring the toner image from the intermediate transfer body onto the recording sheet is selected to be longer than that of the intermediate transfer body. Therefore, the floating toner particles generated at both ends of the brush roll device are made to attach to both ends of the shaft of the intermediate transfer body, and then the floating toner particles are transferred onto the transfer roll device, and are collected by the toner collecting device. Even if the brush roll device comes in sliding contact with the photo-receptor drum and/or the intermediate transfer body to generate a toner cloud, there is no need of providing the sealing member of the sliding contact type, a fan for absorbing the toner cloud, or the like. Further, it is prevented that such a toner cloud diffuses into the image forming apparatus, e.g., copying machine or printer. And, the cleaning of the apparatus inside as well as the reduction of cost to manufacture is realized.

What is claimed is:

1. An image forming apparatus comprising:

at least one image bearing body having a photosensitive layer on the surface thereof, a toner image as defined by image information able to be formed on said photosensitive layer;

an intermediate transfer device having at least one intermediate transfer body to which at least one toner image is transferred from said at least one image bearing body;

a transfer roll device for transferring the at least one toner image from one of the at least one intermediate transfer body of the intermediate transfer device onto a recording sheet;

at least one brush roll device for removing residual toner from the at least one intermediate transfer body of the intermediate transfer device; and a toner collecting device for collecting the toner attached to the surface of said transfer roll device;

wherein an axial length of each said at least one intermediate transfer body is longer than that of at least one of said at least one brush roll device, the axial length of said transfer roll device is longer than that of each said at least one intermediate transfer body, and the axial length of said toner collecting device is longer than that of each said at least one intermediate transfer body.

2. The image forming apparatus according to claim 1, wherein the residual toner held by said at least one brush roll device is gathered onto the surface of said transfer roll device by way of at least one of said at least one intermediate transfer body, and collected in the lump by said toner collecting device.

3. The image forming apparatus according to claim 2, wherein, for each brush roll device, a potential gradient is formed between that brush roll device and a corresponding one of said at least one intermediate transfer body, and causes the toner to transfer between that brush roll device and the corresponding intermediate transfer body.

4. The image forming apparatus according to claim 1, wherein said at least one intermediate transfer body of the intermediate transfer device includes a primary intermediate transfer body to which at least one toner image is primarily transferred from at least one of said at least one image bearing member, and a secondary intermediate transfer body to which the at least one toner image is secondarily transferred from said primary intermediate transfer body, wherein said at least one brush roll device includes a first brush roll for removing the residual toner on said primary intermediate transfer body, and a second brush roll for removing the residual toner on said secondary intermediate transfer body, and wherein an axial length of said primary intermediate transfer body is longer than that of said first brush roll, an axial length of said second brush roll is longer than that of said primary intermediate transfer body, an axial length of said secondary intermediate transfer body is longer than that of said second brush roll, the axial length of said transfer roll device is longer than that of said secondary intermediate transfer body, and the axial length of said toner collecting device is longer than that of said secondary intermediate transfer body.

5. The image forming apparatus according to claim 1, further comprising, for each image bearing body, a refreshing brush for removing toner attached to the surface of that image bearing body, and wherein an axial length of the photosensitive layer formed on the surface of that image bearing body is longer than that of said refreshing brush, and an axial length of each said at least one intermediate transfer body is longer than that of said photosensitive layer.

6. The image forming apparatus according to claim 5, wherein a portion of said axial length of the photosensitive layer formed on the surface of each said image bearing body allows a potential gradient to be formed.

7. The image forming apparatus according to claim 5, wherein each said refreshing brush includes an abrasive brush, provided on the surface of said refreshing brush, for temporarily capturing toner particles attached to the surface of the corresponding image bearing body, and an axial length of each such refreshing brush is a length of that abrasive brush.

8. The image forming apparatus according to claim 1, wherein, for each intermediate transfer body, a portion of said axial length of that intermediate transfer body allows a potential gradient to be formed.

9. The image forming apparatus according to claim 1, wherein each said brush roll device includes an abrasive brush, provided on the surface of that brush roll device, for temporarily capturing the residual toner on a corresponding one of said at least one intermediate transfer body, and an axial length of that brush roll device is a length of that abrasive brush.

10. The image forming apparatus according to claim 1, wherein said intermediate transfer device comprises a plurality of intermediate transfer bodies.

11. The image forming apparatus according to claim 1, wherein the at least one image bearing body comprises a plurality of image bearing bodies.

12. The image forming apparatus according to claim 1, wherein the intermediate transfer device comprises a first primary intermediate transfer body, a second primary intermediate transfer body and a secondary intermediate transfer body, and the first primary intermediate transfer body receives at least one toner image from the at least one image bearing body, the second primary intermediate transfer body receives at least one toner image from at least one other image bearing body, and the secondary intermediate transfer body receives at least one toner images from at least the first primary intermediate transfer body and the second primary intermediate transfer body.

* * * * *